US006419537B1

(12) United States Patent
House et al.

(10) Patent No.: US 6,419,537 B1
(45) Date of Patent: Jul. 16, 2002

(54) SOUND ATTENUATOR AND TEMPERATURE CONTROL DEVICE FOR AN OUTBOARD MOTOR

(75) Inventors: Ian G. House; Michael A. Freund, both of Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/788,771

(22) Filed: Feb. 20, 2001

(51) Int. Cl.[7] ..... B63H 21/38
(52) U.S. Cl. ..... 440/88; 123/41.52
(58) Field of Search ..... 440/88; 123/41.52, 123/41.01

(56) References Cited

U.S. PATENT DOCUMENTS 4,513,696 A 4/1985 Fujii et al. ..... 123/41
4,556,171 A 12/1985 Fukami et al. ..... 237/12
5,149,284 A 9/1992 Kawai ..... 440/52
5,439,404 A 8/1995 Sumigawa ..... 440/88
6,056,611 A 5/2000 House et al. ..... 440/88

*Primary Examiner*—Sherman Basinger
(74) *Attorney, Agent, or Firm*—William D. Lanyi

(57) ABSTRACT

A water reservoir is provided for use in conjunction with the engine of a marine propulsion system. The water reservoir is shaped to comprise two or more water containment cavities that can be located in positions which absorb heat from various heat producing components of the engine and, in addition, serve as sound barriers to attenuate noise emanating from the engine. The water reservoir is connected in fluid communication with the water pump of the marine propulsion system and in fluid communication with a cooling system of the engine.

17 Claims, 5 Drawing Sheets

SOUND ATTENUATOR AND TEMPERATURE CONTROL DEVICE FOR AN OUTBOARD MOTOR

BACKGROUND OF THE INVENTION

1. Field of the Invention

The present is generally related to a method for attenuating the sound emanating from an outboard motor engine and also providing a heat sink for the engine and, more particularly, to a water reservoir shaped to cover certain preselected regions of the engine.

2. Description of the Prior Art

Liquid reservoirs are used for various purposes in conjunction with engines known to those skilled in the art. U.S. Pat. No. 6,056,611, which issued to House et al on May 2, 2000, discloses an integrated induction noise silencer and oil reservoir. The reservoir is used as a sound attenuator in an outboard motor and is placed under the cowl of the outboard motor with the throats of the engine's throttle bodies disposed between the oil reservoir and the engine itself. This allows the sound emanating from the throttle bodies to be attenuated by the oil reservoir which is cup-shaped to partially surround the throat of the throttle bodies. A plate member can be attached to a hollow wall structure in order to enclose a cavity therebetween. The structure therefore serves as an oil reservoir for the engine and also as a sound attenuating member.

U.S. Pat. No. 4,513,696, which issued to Fujii on Apr. 30, 1985, describes an apparatus for charging cooling liquid to engine cooling system. The apparatus comprises an additive reservoir for storing an additive such as an anti-icing agent, a cooling water reservoir for storing cooling water, a filler head adapted to be connected with an coolant inlet of an automobile engine cooling system, additive conduits extending between the additive reservoir and the filler head, cooling water conduits extending between the cooling water reservoir. Additive control valves are provided in the additive conduits for controlling the quantity of the additive supplied to the engine cooling system in accordance with the capacity of the cooling system and a desired concentration of the additive. Cooling water control valves are also provided in the cooling water conduits for controlling the quantity of cooling water supplied to the engine cooling system in accordance with the capacity of the cooling system and the desired concentration of the additive, whereby the cooling water is charged to the engine cooling system with the desired concentration of the additive.

U.S. Pat. No. 4,566,171, which issued to Fukami et al on Dec. 3, 1985, describes a heating system for automobiles with heat storage tank. The system utilizes the hot water from the engine cooling system as a heat source and includes a heating radiator and a heat accumulating water tank, and pipe lines are provided between the engine cooling system, heating radiator, and heat accumulating water tank. The flow passages of the cooling water through the pipe lines are switched by electromagnetic valves provided in the pipe lines so that the heating radiator and the heat accumulating water tank are connected in series or in parallel with each other with respect to the engine cooling system, or a circulating passage is formed between the heating radiator and the heat accumulating water tank. The heat accumulating water tank has a mixing preventing device to prevent cold cooling water flowing into the water tank from mixing with hot water contained in the water tank.

U.S. Pat. No. 5,149,284, which issued to Kawai on Sep. 22, 1992, describes an exhaust system for an outboard motor. The device is adapted to be embodied in an outboard motor that is comprised of a power head having an internal combustion engine surrounded by a protective cowling. The engine includes an exhaust port in communication with an exhaust pipe for discharging exhaust gases from the engine. A steering shaft is affixed to the drive shaft housing by upper and lower connections which include elastic bushings. An upper reservoir receives cooling water from the engine to cool structures adjacent the exhaust pipe and specifically the elastic bushings. The reservoir is dammed up on the forward side by the bushing and receives cooling form the cooling water.

U.S. Pat. No. 5,439,404, which issued to Sumigawa on Aug. 8, 1995, describes a cooling system for an outboard motor. The cooling system is intended to provide cooling for an outboard motor and specifically for the lubricating reservoir thereof. The lubricating reservoir depends into the drive shaft housing and is surrounded by an open trough-like water manifold to which cooling water is delivered from the engine. The manifold has lower restrictive openings which direct the coolant to the outer peripheral wall of the oil pan of the lubricant reservoir. The water level is maintained by a weir-like structure and the water that overflows the weir is also directed toward the outer surface of the lubricant reservoir.

Two problems exist in relation to outboard motors. First, noise emanates from various portions of the engine of an outboard motor and, when the level of noise exceeds certain limits, the enjoyment of the use of a marine vessel propelled by the outboard motor is affected. A second problem relating to outboard motors is that, under certain conditions, heat from the engine block and cylinder head portion of the engine raises the temperature of the fuel system components after the engine is turned off. Also, in four cycle engines, heat from an oil sump can also raise this temperature. If this increased temperature of the fuel system components causes vaporization of the fuel within those components, vapor lock can result.

It would therefore by significantly beneficial if a means could be provided to reduce the vapor lock problem and to reduce the sound emanating from the engine. It would be particularly beneficial if a common device could be provided which addresses both problems by attenuating the sound emanating from the engine of an outboard motor while also absorbing heat from the engine, when the engine is turned off, and preventing that heat from raising the temperature of fuel within the fuel system of the engine.

SUMMARY OF THE INVENTION

An outboard motor made in accordance with a preferred embodiment of the present invention comprises a water cooled engine having at least one cooling passage formed within the engine. It further comprises a water pump for drawing water from a body of water and causing the water to flow through the cooling passage of the engine. In addition, a preferred embodiment of the present invention further comprises a water reservoir that is connected in fluid communication between the water pump of the outboard motor and the cooling passage within the water cooled engine. The reservoir is shaped to define a plurality of water containment cavities, in which each of the water containment cavities is connected in fluid communication with at least one other of the plurality of water containment cavities. The reservoir is attachable to the engine in order to dispose a first one of the plurality of water containment cavities proximate a first surface portion of a first side of the engine and to further dispose a second one of the plurality of water containment cavities proximate a second surface of a second side of said engine.

The reservoir can be connected in fluid communication with a water pump by a first tube and also connected in fluid communication with the cooling passage by a second tube. The reservoir can also be shaped to dispose a third one of the plurality of water containment cavities proximate a third surface portion of a third side of the engine. The first, second, and third sides of the engine can be the top side, port side, starboard side, front side, or rear side, in any preselected combination. The first surface portion of the engine can be a sound producing portion, such as an exhaust manifold or intake manifold, or a heat producing portion of the engine, such as an exhaust manifold or cylinder head portion of the engine.

BRIEF DESCRIPTION OF THE DRAWINGS

The present invention will be more fully and completely understood from a reading of the description of the preferred embodiment, in conjunction with the drawings, in which.

DESCRIPTION OF THE PREFERRED EMBODIMENT

Figure 1:
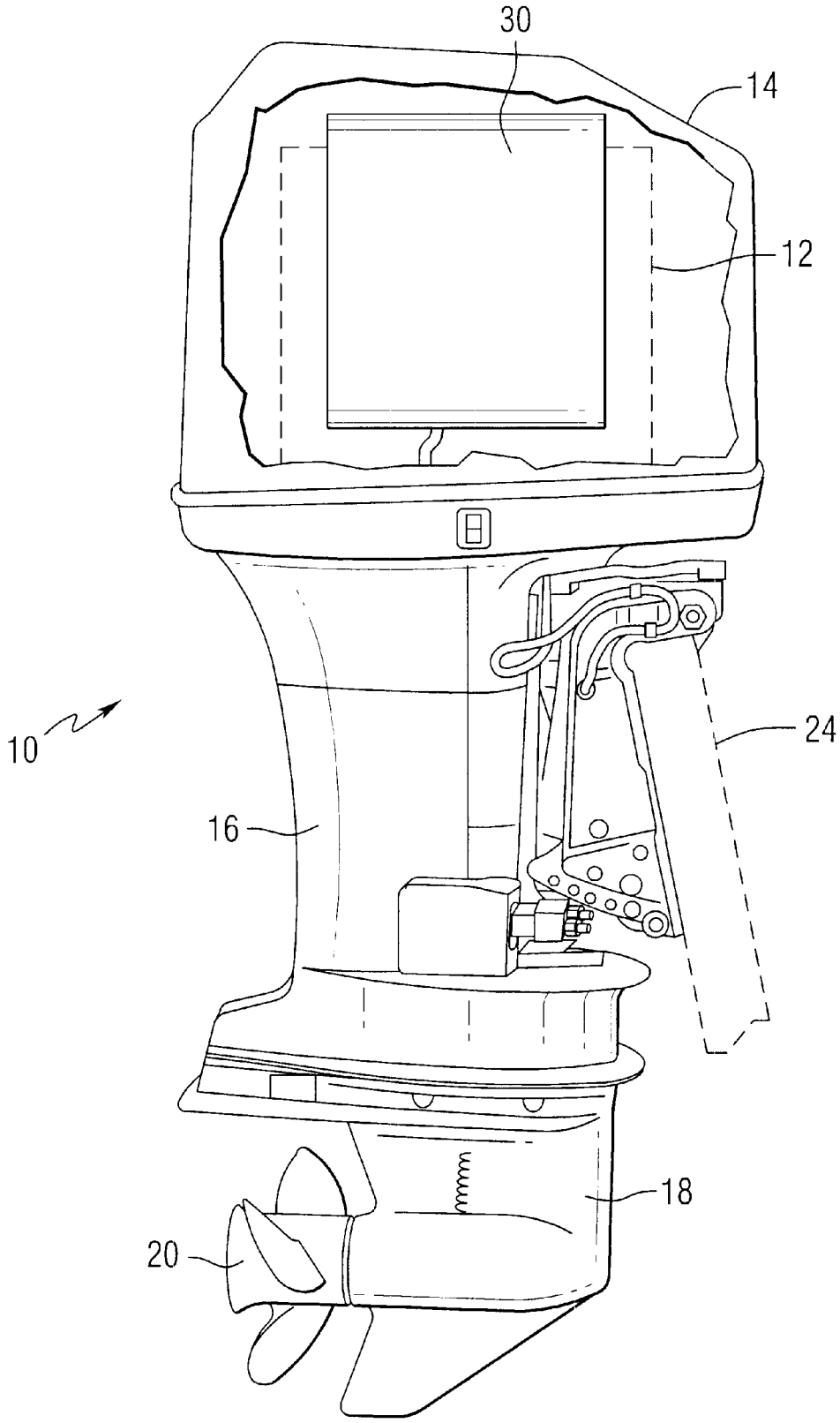
FIG. 1 shows an outboard motor incorporating the present invention.

Throughout the description of the preferred embodiment of the present invention, like components will be identified by like reference numerals.

FIG. 1 shows an outboard motor 10 which comprises an engine 12 represented by a dashed line visible through a cutout portion of the cowl 14. A driveshaft housing 16 extends downward from the engine 12 and supports a gearcase 18. The gearcase 18 and the driveshaft housing 16 contain torque transmitting shafts and gears which allow the engine 12 to transmit torque to a propeller 20. The outboard motor 10 is attachable to a transom 24 of a marine vessel.

With continued reference to FIG. 1, the present invention provides a water reservoir 30 that is connected in fluid communication between a water pump, which is typically located in the gearcase 18, and a cooling passage within the engine 12. Although the cooling passage is not shown in FIG. 1, those skilled in the art of water cooled engines are intimately familiar with the various shapes and structures of cooling passages and water jackets used to remove heat from internal combustion engines 12.

In FIG. 1, the water reservoir 30 is shown in close proximity to the engine 12. As will be described in greater detail below, this close proximity between the water reservoir 30 and the engine 12 serves two purposes, the attenuation of sound and the removal of heat from the engine 12, particularly after the engine 12 is turned off.

Figure 2:
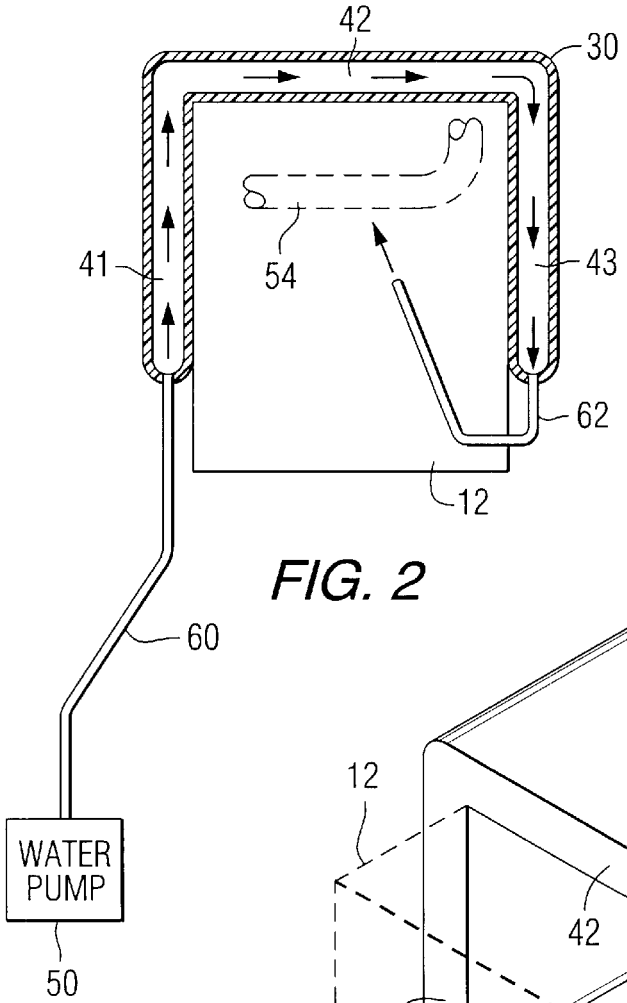
FIG. 2 is a sectional view of a water reservoir made in accordance with the present invention.

FIG. 2 shows a section view of the water reservoir 30 in relation to the engine 12. The water reservoir, which is typically made of plastic and shaped to define water containment cavities, is disposed to cover the top and sides of the engine 12. In FIG. 2, three water containment cavities, 41–43, are illustrated as part of the water reservoir 30. Each of the water containment cavities, 41–43, are connected in fluid communication with at least one other one of the plurality of water containment cavities. In other words, the water in cavity 41 can flow freely into cavity 42 and the water in cavity 42 can flow freely into the cavity 43. A water pump 50 is used to draw water from a body of water in which the marine vessel is used. This causes the water to flow through the cooling passage 54 which is represented by a dashed line illustration. It should be understood that the cooling passage 54 of the engine 12 can be located at various locations within the engine block and cylinder head of the engine 12. A first tube 60 connects the water pump 50 in fluid communication with the water reservoir 30 and, more particularly, with the water containment cavity 41. Water containment cavity 43 is connected in fluid communication, by a second tube 62, with the cooling passage 54 of the engine 12.

During normal operation, water is pumped by the water pump 50 from the body of water in which the marine vessel is operated, and the water flows through the first tube 60 into the cavities of the water reservoir 30. These cavities are shaped to be disposed around the top and sides of the engine 12, as illustrated in FIG. 2, and to direct the water toward a second tube 62 which conducts it to the cooling passage 54 of the engine 12. The arrows shown within the water containment cavities, 41–43, illustrate this direction of flow of water through the water reservoir 30.

Figure 3:
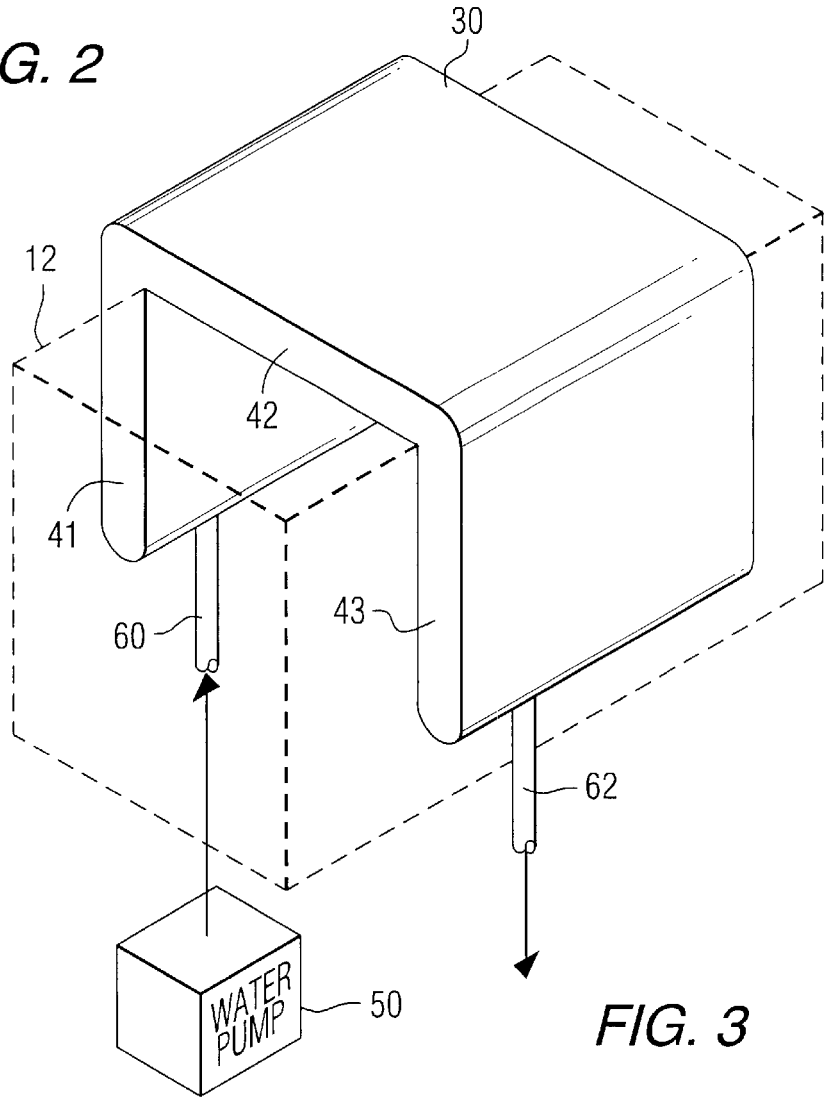
FIG. 3 is an isometric view of the water reservoir of the present invention.

FIG. 3 shows the water reservoir 30 in an isometric view. The shape illustrated in FIG. 3 allows the water reservoir 30 to straddle the engine 12 which is illustrated by dashed lines in FIG. 3. This straddling of the engine 12 allows the water containment cavities, 41–43, to cover certain portions of the engine for the purpose of attenuating the sound emanating from the engine or providing heat absorption from heat producing portions of the engine 12. When the water reservoir 30 is generally filled with cooling water drawn from a body of water, its temperature is significantly lower than the temperature of the engine 12. After the engine 12 is turned off, this differential in temperature between the water within the water reservoir 30 and the engine 12, allows the water reservoir 30 to absorb a significant amount of heat and prevent that heat from being transferred to components of the fuel system of the engine 12. As a result, the fuel within the fuel system components is prevented from being heated above its vaporization temperature, which could cause vapor lock.

In FIGS. 1–3, the heat producing portions and sound emanating portions are not illustrated specifically. However, as is well known to those skilled in the art, the sound producing portions of the engine 12 include the exhaust components and air intake components. Furthermore, the heat producing components include the exhaust manifold, oil sump, and cylinder head portions of the engine 12. The locations of these components can vary from one engine design to another, but those skilled in the art are very much aware of the possible locations of both the heat producing portions and sound emanating portions of the engine 12.

FIGS. 4A–4D represent various alternative embodiments of the present invention. Throughout the description of FIGS. 4A–4D, the conduits, 60 and 62, and the water pump 50 will not be described in detail. They would be located at appropriate locations to allow water to be pumped by the water pump into the cavities of the water reservoir 30 and to be conducted out of the cavities toward the cooling passages of the engine 12.

Figure 4A:
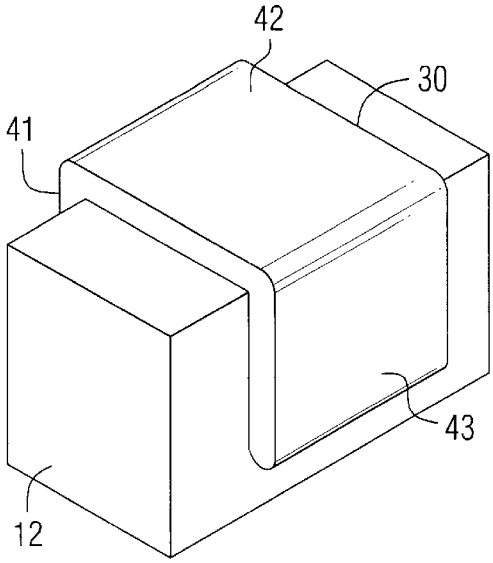
FIGS. 4A–4D show various alternative configurations of the present invention.

FIG. 4A is generally similar to the configuration described above in conjunction with FIGS. 2 and 3. The water reservoir 30 is shaped to cover the top end two sides of the engine 12. The three water containment cavities, 41–43, are each connected in fluid communication with each other and shaped to straddle the engine 12.

Figure 4B:
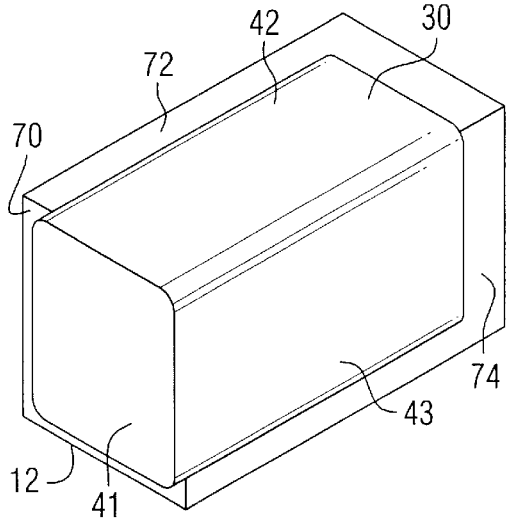

FIG. 4B is an alternative embodiment of the present invention in which the water reservoir 30 is provided with water containment cavities, 41–43, that are shaped to cover preselected portions of the front side 70, the top side 72, and either the port or starboard side 74.

Figure 4C:
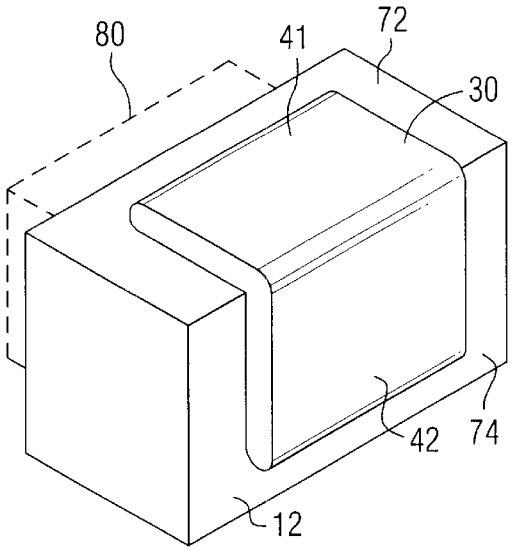

FIG. 4C shows a water reservoir 30 in which only two water containment cavities, 41 and 42, are provided. This shape, illustrated in FIG. 4C, can be used when the heat and/or sound emanating portions of the engine 12 are primarily located near the top side 72 and either the port or starboard side 74. This shape illustrated in 4C can also be used in situations where certain components, represented by dashed lines 80, prevent a convenient location of one of the water containment cavities on a particular side of the engine.

Figure 4D:
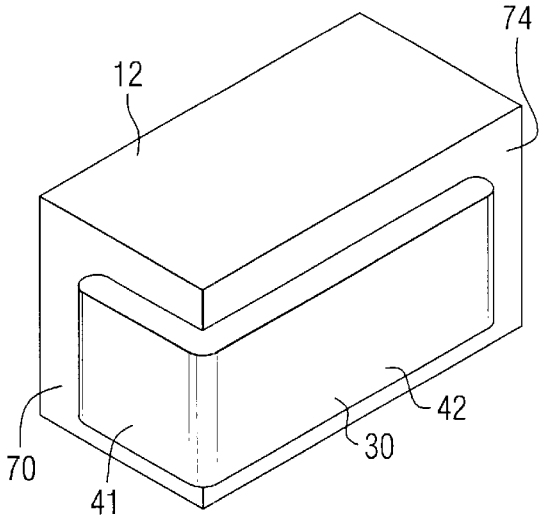

FIG. 4D shows a water reservoir 30 having a first side 41 disposed near the front side 70 of the engine 12 and a second water containment cavity 42 disposed near the port or starboard side 74 of the engine 12.

It should be understood that the flow of water into the water reservoir 30 can be in series, either upstream from the engine 12 or downstream from the engine 12, or can be connected in parallel with a primary flow of cooling water into the cooling passages of the engine. A preferred embodiment of the present invention places the water reservoir 30 upstream from the engine so that the water within the water reservoir 30 is at its coldest possible temperature in the event that the engine 12 is turned off. The water flow through the water reservoir 30 is continuous during operation of the engine and therefore ensures that a fresh supply of cold water is within the reservoir when the engine is switched off. A valve, either a reed or poppet valve can be included at the outlet of the water reservoir and this valve is overcome by the pressure generated by the water pump, but closes to prevent drainage when the engine stops. A mechanically operated drain might also be necessary to drain the water during cold weather conditions. This drain can be manually operated with a switch to open the valve and may also be electronically operated by the engine control unit, based on time or temperature, or operated by a temperature sensitive device such as a bimetallic thermostat which opens a valve when the temperature drops toward freezing.

When the engine of an outboard motor is turned off, the engine block temperature initially increases. If no precautions, such as the present invention, are taken, the heat from the engine will be transmitted to the air under the cowl of the outboard motor and the temperature of the fuel system components will increase. This can cause vapor lock by creating fuel vapors within the components and conduits of the fuel system. When the present invention is used, the heat energy emanating from the engine block is absorbed by the water within the water reservoir 30. As a result, the temperature under the cowl and surrounding the fuel system components will be minimized and vapor lock can be avoided. Portions of the water reservoir 30 can also be shaped to serve as a barrier between certain hot engine block areas and the fuel system components. Additionally, the water reservoir 30 can be shaped so that its water containment cavities serve as a support structure for fuel system hoses, conduits, and other heat sensitive components. This intimate relationship between the fuel system components and the water reservoir 30 will serve to enhance cooling of these components.

Figure 5:
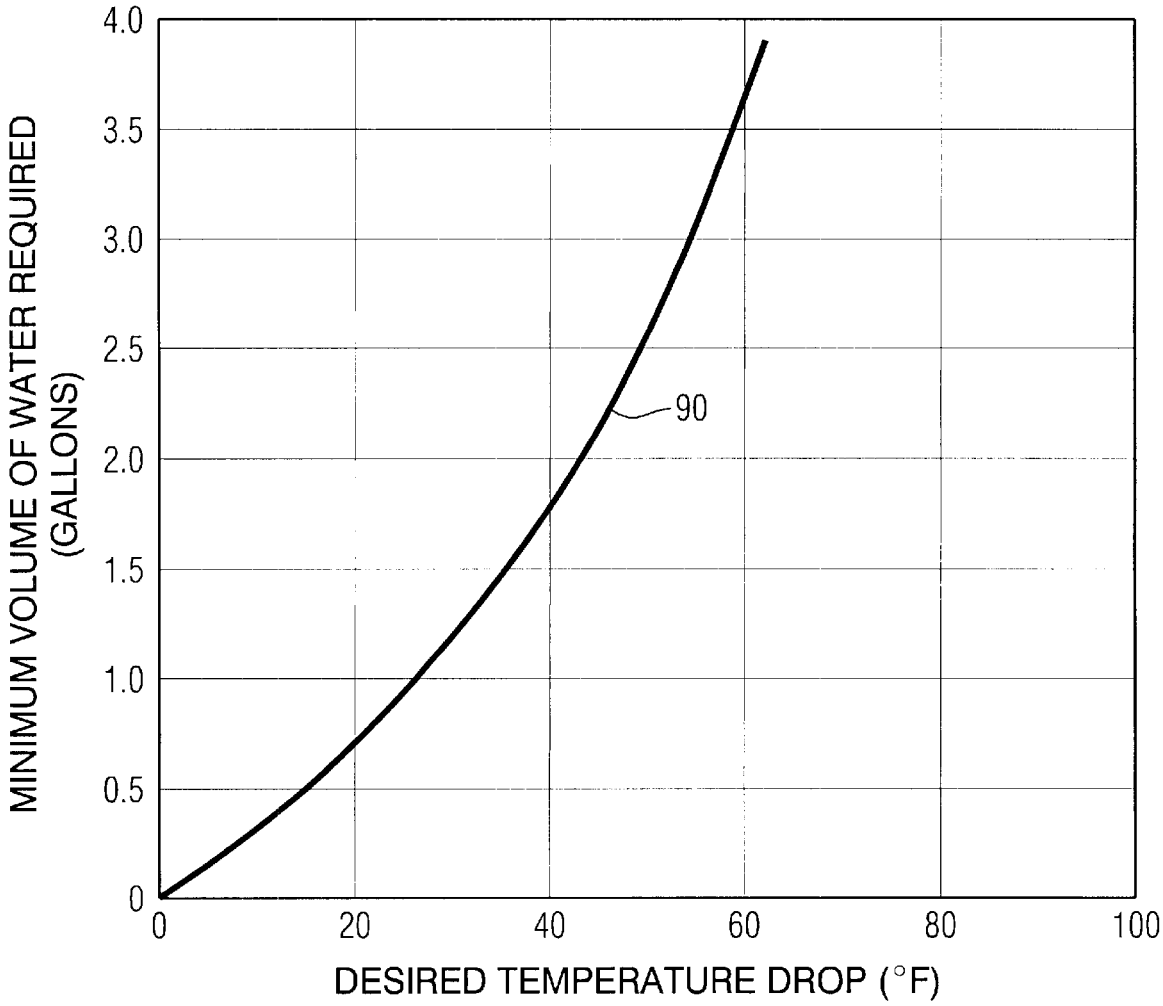
FIG. 5 is a graphical representation of the relationship between a desired temperature drop for an engine block and the volume of water needed to achieve that temperature drop.

The present invention is able to serve its intended purpose regarding heat absorption because the specific heat capacity of water is more than four times higher than that of aluminum, which is often used as the material for manufacturing the engine 12. FIG. 5 is a graphical representation of the relationship between the desired temperature drop of the engine block, in degrees F. and the minimum volume of water required to achieve the temperature block. The water volume is measured in gallons in FIG. 5. For purposes of the empirical representation of FIG. 5, the mass of the engine block is assumed to be 150 lbs., the water temperature of the body of water from which it is drawn by the water pump 50 is assumed to be 85° F., and the peak engine block temperature is assumed to be 200° F. For simplification, the calculations used to determine the graphical representation of FIG. 5 assume that no heat is radiated from the cowl 14 of the engine and that the cowl act as a perfect insulator. The volume of water required to absorb the heat energy from the block, so that the temperature of the engine drops by a certain desired amount, was calculated and used to determine the relationship between the water volume and the desired temperature drop. This is identified by line 90 in FIG. 5. The rate at which this heat is absorbed by the water in the water reservoir 30 is not described herein and was not included in the software program used to generate the line 90 in FIG. 5. This rate of heat exchange will depend on many factors, including the material type used for the reservoir walls, the engine, the cowl, and other components located under the cowl. In addition, the actual shape of the water reservoir 30 and the proximity of the reservoir to heat sources will affect the rate of heat exchange. FIG. 5 shows that a potentially significant temperature drop can be achieved with a reasonable quantity of water, even with a high water temperature of 85° F., provided that the required temperature reduction is less than the difference in temperature between the engine block and the water drawn from the body of water in which the marine vessel is operated.

In order to achieve the maximum advantage available through the use of the present invention, certain design criteria should be followed. For example, the water reservoir 30 should be shaped to provide maximum surface area so that the rate of absorption of heat by the water within the water reservoir 30 is optimized. The device should be located as closely as possible to major heat sources, such as the exhaust manifold, cylinder head, and flywheel, to optimize the efficiency of heat transfer between those components and the water within the water reservoir. The material used to make the water reservoir, along with its texture and color, should be chosen to maximize heat transfer at a reasonable cost. A plastic material that has a high thermal conductivity, in combination with a dark color, is suggested. If possible, portions of the water reservoir should be located between heat sources and components of the fuel system. If the water reservoir is shaped to cover as much of the engine as possible, acoustic benefits will be optimized, particularly if portions of the water reservoir are located between the main noise sources and the operator or passengers of the marine vessel. It is possible that the water containment cavities of the water reservoir 30 can be shaped to serve other functions, such as a flywheel cover or hose support, in order to make the device more cost effective and beneficial.

The water reservoir and its water containment cavities should be shaped to be easily removable from the engine and, if possible, not located at positions that may obscure access to service items such as spark plugs, throttle linkages, and other components. The drainage system, through which water can be removed from the water reservoir, can be manually operated or can be automatic, in that it is based on either a timing apparatus or a temperature control device. Although the present invention has been described in relation to an outboard motor, it should be understood that it is applicable for use with engines of stern drive systems or inboard marine propulsion systems.

Figure 6:
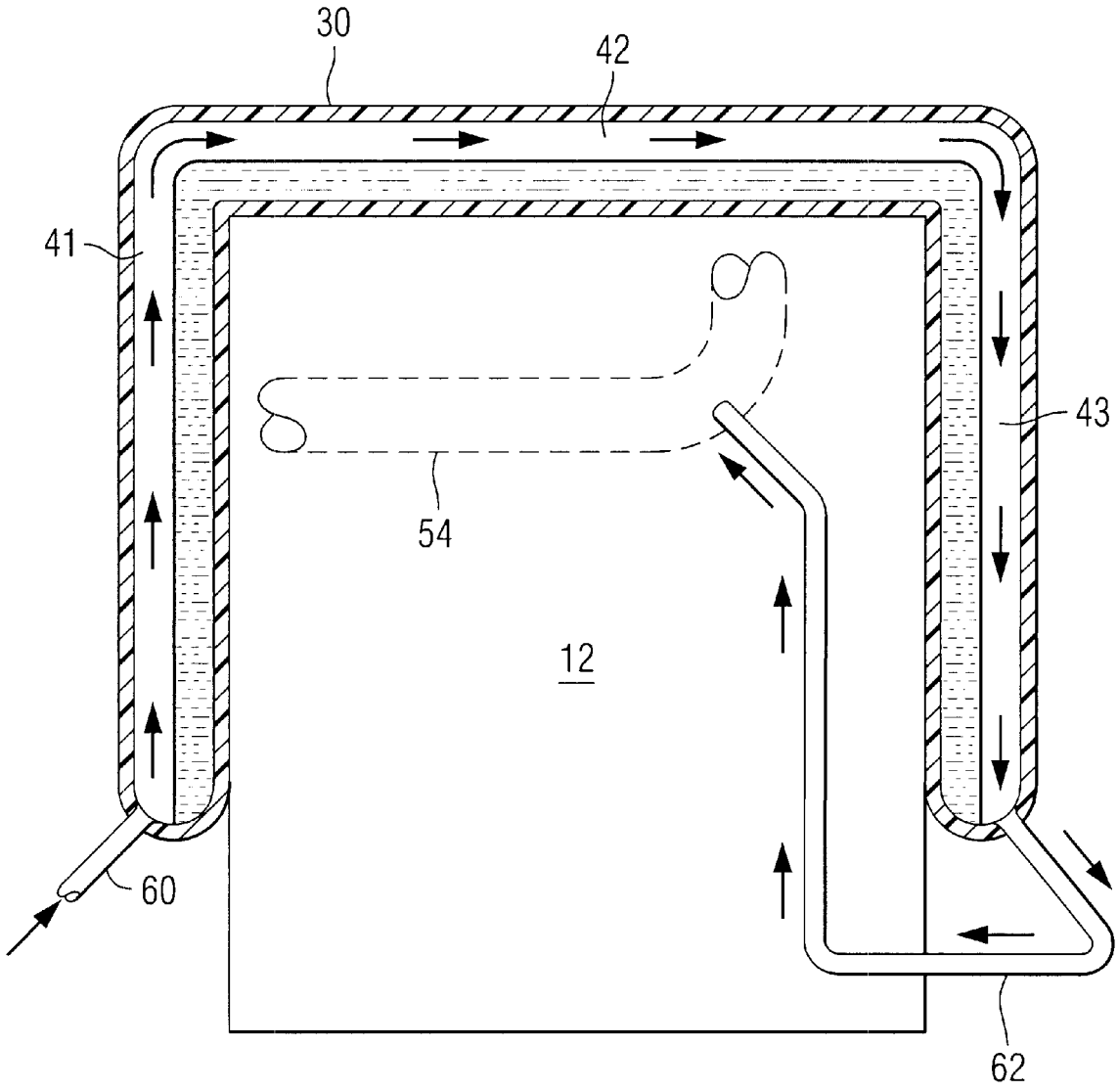
FIG. 6 is an alternative embodiment of the present invention.

FIG. 6 shows an embodiment of the present invention in which the water reservoir 30 is associated with a coolant reservoir 100. The coolant reservoir 100 can be filled with a suitable coolant, such as ethylene glycol or other type of antifreeze material. The embodiment shown in FIG. 6 is particularly advantageous when used in conjunction with a coolant in the coolant reservoir which has a relatively high specific heat. As water is circulated through the water reservoir 42, as represented by the arrows in FIG. 6, the temperature of the coolant within the coolant reservoir 100 is lowered to a magnitude approximately equal to the temperature of the water flowing through the water reservoir 42.

Then, when the engine 12 is turned off, the outer surfaces of the engine 12 are in intimate thermal communication with the coolant in the coolant reservoir 100 which is at a temperature that is approximately equal to the water that had been used to remove heat from the coolant. After the engine 12 is turned off, heat from the engine will be absorbed by the coolant in the coolant reservoir 100 and this thermal communication will decrease the likelihood that the heat from the engine 12 will be conducted to the fuel system components and lead to a "vapor lock" condition. The presence of the coolant within the coolant reservoir 100 will also combine with the sound attenuating characteristics of the water reservoir 42. Both reservoirs shown in FIG. 6 will serve to attenuate the sound emanating from the engine when the engine is operating and will serve to absorb heat from the engine after the engine is turned off.

A particular advantage of the embodiment shown in FIG. 6 is that no valving is necessary in the water reservoir 42 or its conduits, 60 and 62. When the engine is turned off, all of the water in the water reservoir 42 can be allowed to drain out of the water reservoir 42 since the thermal absorption characteristics of the present invention will be provided by the coolant in the coolant reservoir 100 which is at a temperature generally equivalent to the temperature of the cooling water at the moment when the engine 12 is turned off.

Although the present invention has been described in particular detail in terms of an outboard motor, it should be understood that the marine propulsion device of the present invention can also be the engine of an inboard marine propulsion system or a stern drive system. It should therefore be understood that alternative embodiments of the present invention are also within its scope.

We claim:

1. A marine propulsion device, comprising:

a water cooled engine having at least one cooling passage formed within said engine;

a water pump for drawing water from a body of water and causing said water to flow through said cooling passage;

a water reservoir connected in fluid communication between said water pump and said cooling passage within said water cooled engine, said reservoir being shaped to define a plurality of water containment cavities, each of said water containment cavities connected in fluid communication with at least one other of said plurality of water containment cavities, said reservoir being attachable to said engine to dispose a first one of said plurality of water containment cavities proximate a first surface portion of a first side of said engine and to dispose a second one of said plurality of water containment cavities proximate a second surface of a second side of said engine and a coolant reservoir containing a liquid disposed in thermal communication with said engine and with said water reservoir.

2. The marine propulsion device of claim 1, further comprising:

a first tube connecting said water reservoir in fluid communication with said water pump; and a second tube connecting said water reservoir in fluid communication with said cooling passage.

3. The marine propulsion system of claim 1, wherein:

said liquid within said coolant reservoir is ethylene glycol.

4. The marine propulsion device of claim 1, wherein:

said water reservoir is shaped to dispose a third one of said plurality of water containment cavities proximate a third surface portion of a third side of said engine.

5. The marine propulsion device of claim 1, wherein:

said first side is a top side of said engine.

6. The marine propulsion device of claim 1, wherein:

said first side is an port side of said engine.

7. The marine propulsion device of claim 1, wherein:

said first side is a port side of said engine and said second side is a starboard side of said engine.

8. The marine propulsion device of claim 1, wherein:

said first side is a front side of said engine.

9. The marine propulsion device of claim 1, wherein:

said first side is a rear side of said engine.

10. The marine propulsion device of claim 1, wherein:

said marine propulsion device is an outboard motor.

11. The marine propulsion device of claim 1, wherein:

said first surface portion is a sound producing portion of said engine.

12. The marine propulsion device of claim 1, wherein:

said first surface portion is a heat producing portion of said engine.

13. A marine propulsion device, comprising:

a water cooled engine having at least one cooling passage formed within said engine;

a water pump for drawing water from a body of water and causing said water to flow through said cooling passage;

a water reservoir connected in fluid communication between said water pump and said cooling passage within said water cooled engine, said reservoir being shaped to define a plurality of water containment cavities, said reservoir being attachable to said engine to dispose a first one of said plurality of water containment cavities proximate a first surface portion of a first side of said engine and to dispose a second one of said plurality of water containment cavities proximate a second surface of a second side of said engine and to dispose a third one of said plurality of water containment cavities proximate a third surface portion of a third side of said engine; and a coolant reservoir containing a liquid disposed in thermal communication with said engine and with said water reservoir, said liquid within said coolant reservoir being ethylene glycol.

14. The marine propulsion device of claim 13, further comprising:

a first tube connecting said water reservoir in fluid communication with said water pump; and a second tube connecting said water reservoir in fluid communication with said cooling passage.

15. The marine propulsion device of claim 13, wherein:

said first surface portion is a sound producing portion of said engine and said second surface portion is a heat producing portion of said engine.

16. A marine propulsion device, comprising:

a water cooled engine having at least one cooling passage formed within said engine;

a drive shaft housing supporting a gear case;

a propeller supported by said gear case;

a water pump for drawing water from a body of water and causing said water to flow through said cooling passage;

a water reservoir connected in fluid communication between said water pump and said cooling passage within said water cooled engine, said reservoir being shaped to define a plurality of water containment cavities, said reservoir being attachable to said engine to dispose a first one of said plurality of water containment cavities proximate a first surface portion of a first side of said engine and to dispose a second one of said plurality of water containment cavities proximate a second surface of a second side of said engine and to dispose a third one of said plurality of water containment cavities proximate a third surface portion of a third side of said engine, said first side being a top side of said engine, said second side being an port side of said engine and said third side being a starboard side of said engine; and a coolant reservoir containing a liquid disposed in thermal communication with said engine and with said water reservoir.

17. The marine propulsion device of claim 16, further comprising:

a first tube connecting said water reservoir in fluid communication with said water pump; and a second tube connecting said water reservoir in fluid communication with said cooling passage.

* * * * *